United States Patent [19]

Byers

[11] Patent Number: 4,855,281

[45] Date of Patent: Aug. 8, 1989

[54] STABILIZER-DONOR ELEMENT USED IN THERMAL DYE TRANSFER

[75] Inventor: Gary W. Byers, Webster, N.Y.

[73] Assignee: Eastman Kodak Company, Rochester, N.Y.

[21] Appl. No.: 112,907

[22] Filed: Oct. 23, 1987

[51] Int. Cl.[4] ..... B41M 5/035; B41M 5/26

[52] U.S. Cl. ..... 503/227; 8/471; 428/195; 428/480; 428/913; 428/914

[58] Field of Search ..... 8/470, 471; 427/146, 427/256; 428/195, 480, 913, 914; 430/200, 201, 945; 503/227, 201

[56] References Cited

FOREIGN PATENT DOCUMENTS 147747 7/1985 European Pat. Off. ..... 503/227

182785 10/1984 Japan ..... 503/227

1058791 3/1986 Japan ..... 503/227

241191 10/1986 Japan ..... 503/227

*Primary Examiner*—Bruce H. Hess

*Attorney, Agent, or Firm*—Harold E. Cole

[57] ABSTRACT

A stabilizer-doner element for thermal dye transfer comprising a support having on one side thereof a stabilizer dispersed in a polymeric binder, and on the other side thereof a slipping layer comprising a lubricant.

The polymeric binder may also have a dye dispersed therein. Examples of stabilizers include phenolic antioxidants, multialkoxy-substituted aromatic compounds and singlet oxygen quencher metal chelates such as nickel dithiocarbamates.

18 Claims, No Drawings

STABILIZER-DONOR ELEMENT USED IN THERMAL DYE TRANSFER

This invention relates to stabilizer-donor elements used in thermal dye transfer to provide increased stability of the transferred dye to light.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

All imaging dyes are unstable to light to a greater or lesser degree. Dyes are known to photolytically degrade via a number of paths which often involve dye triplet states, radicals and/or singlet oxygen. Any improvement in light stability is highly desirable.

Various stabilizers are known in silver halide photographic systems. However, many of these stabilizers are highly colored or may become colored during keeping by the formation of degradation products. This prevents their use in many systems as unacceptable stain will result.

In EPA 147,747, JP 59/182,785, and U.S. Pat. Nos. 4,705,521 and 4,705,522, the use of stabilizers are disclosed for thermal transfer systems. However, the stabilizers are disclosed therein for use in the dye-receiver element.

There is a problem with having stabilizers in the dye-receiving element in that any color of the stabilizer will be noticeable. The color of the stabilizer is especially objectionable in the Dmin areas.

It would be desirable to provide a way to employ stabilizers in thermal dye transfer systems without causing objectionable stain in the dye-receiving elements.

These and other objects are achieved by a stabilizer-donor element in accordance with the invention which comprises a support having on one side thereof a stabilizer dispersed in a polymeric binder, and on the other side thereof a slipping layer comprising a lubricant.

By employing the stabilizer in a donor element, it may be imagewise transferred in a separate heating cycle where it is needed. Thus, any inherent color will be least noticed. The stabilizer may also be incorporated into a dye layer of a dye-donor element so that it will be simultaneously transferred with the dye. This is advantageous in that little or no stabilizer will be transferred to Dmin areas, thus producing little or no stain. Also, in Dmax areas, higher amounts of stabilizer will be transferred in areas where higher amounts of dye will be transferred.

Thus, the stabilizer may be incorporated into a separate donor element, it may be incorporated in to the dye layer of a dye-donor element, or it may be used in a separate portion of a dye-donor element with repeating areas of dyes, i.e, cyan dye, magenta dye, yellow dye, stabilizer, etc.

In a preferred embodiment of the invention, the stabilizer is incorporated into the polymeric binder of the dye layer in a dye-donor element.

Any stabilizer can be employed in the invention provided it can be thermally transferred. It can be employed in any amount which will be effective for the intended purpose. In general, good results have been obtained at about 0.02 to about 0.5 g/m$^2$ of the dye-donor or stabilizer-donor element.

In a preferred embodiment of the invention, the stabilizer is a phenolic antioxidant, a multialkoxy-substituted aromatic compound, or a singlet oxygen quencher metal chelate, preferably a nickel chelate.

The term singlet oxygen quencher metal chelate as used herein means a material that deactivates excited state singlet oxygen, produced by dye-sensitized interaction with molecular oxygen, by conversion to the ground state. See: V. Shlyapentokh and V.B. Inavov, Russian Chem. Revs., 42(2) 1976, pp. 99–110.

In a preferred embodiment of the invention, the stabilizer has the formula:

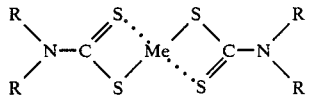

wherein Me is a metal such as Ni(II), CO(II) or Fe(II) and each R independently represents a substituted or unsubstituted alkyl group having from 1 to about 10 carbon atoms, such as —$CH_3$, —$C_2H_5$, —$CH(CH_3)_2$, —$CH_2$—$CH_2$—O—$CH_3$,

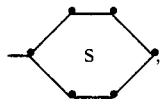

—n—$C_4H_9$, i—$C_4H_9$, t—$C_5H_{11}$; a substituted or unsubstituted aryl group having from about 6 to about 10 carbon atoms such as

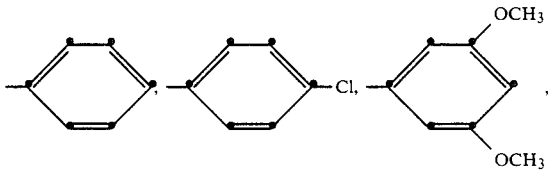

-continued

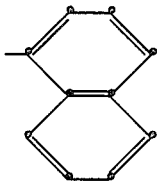

or two R's may be combined together with the N to which they are attached to form a ring such as

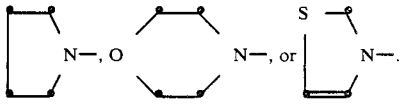

In another preferred embodiment of the invention, Me in the above formula is nickel(II) and each R is a n-butyl group.

Examples of stabilizers which can be employed in the invention include the following:

Phenolic antioxidants

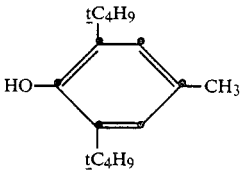

(1)

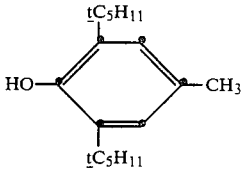

(2)

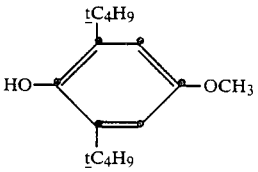

(3)

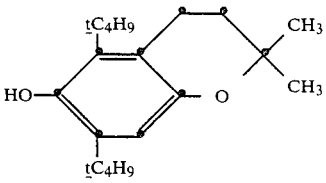

(4)

Multialkoxy-substituted aromatic compounds 1,2,4-tri-n-butoxy benzene (5)

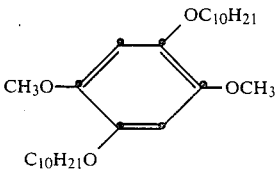

(6)

-continued

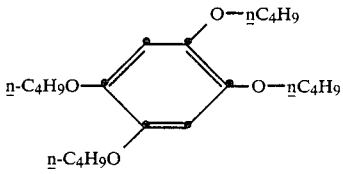

(7)

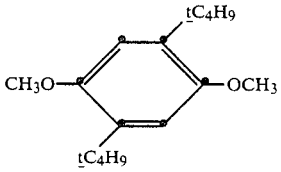

(8)

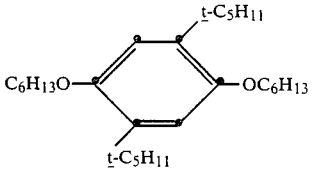

(9)

Singlet oxygen quencher metal chelates bis(N,N—di-n-butyldithiocarbamate)nickel(II)

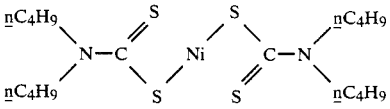

(10)

(available commercially from duPont as Rylex NBC ®)

bis(N,N—di-n-butyldithiocarbamate)cobalt(II) (11)

bis(N,N—di-n-butyldithiocarbamate)iron(II) (12)

bis(N,N—di-i-propyldithiocarbamate)nickel(II) (13)

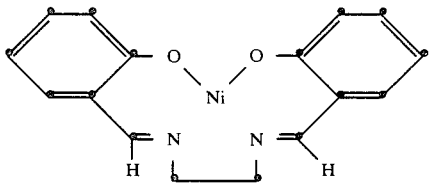

(14)

bis(o-(N—methylformimidoyl)phenol)nickel(II) (15)

($C_{20}H_{24}N_{20}Ni^{2+}$)

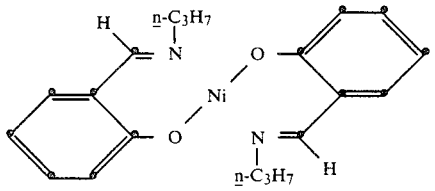

(16)

Miscellaneous diazobicyclooctane (17)

-continued (18)

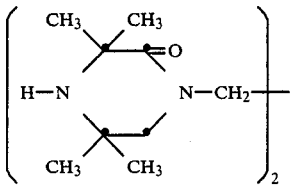

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dies such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

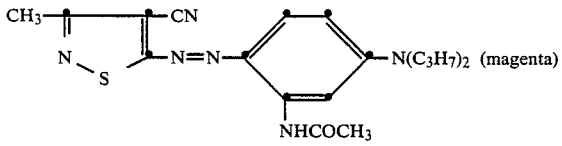

(magenta)

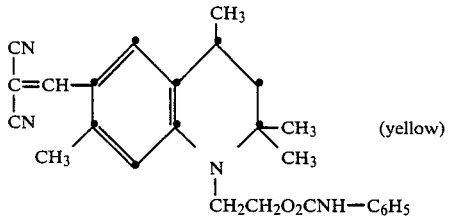

(yellow)

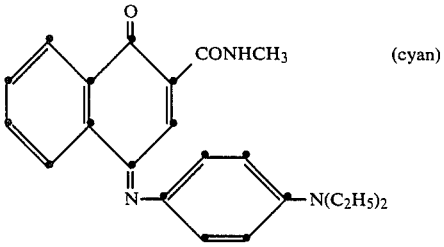

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate, poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

A dye-barrier layer may be employed in the dye-donor elements of the invention to improve the density of the transferred dye. Such dye-barrier layers materials include hydrophilic materials such as those described and claimed in U.S. Pat. No. 4,700,208 of Vanier, Lum and Bowman.

Any material can be used as the support for the dye-donor or stabilizer-donor element of the invention provided it is dimensionally stable and can withstand the heat of the thermal printing heads. Such materials, include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

The reverse side of the dye-donor element or stabilizer-donor element is coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal) poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as poly(ether sulfone), a polyimide, a cellulose ester such as cellulose acetate, a poly(vinyl alcohol-co-acetal) or a poly(ethylene terephthalate). The support for the dye-receiving element may also be reflective such as barytacoated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, a polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye thereon or may have alternating areas of different dyes, such as sublimable yellow, cyan and/or magenta and/or black or other dyes. Such dyes are disclosed in U.S. Pat. No. 4,541,830, the disclosure of which is hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-dnor element (or another area of the donor element with a different dye area) is then brought in register with the dye-receiving element and the process repeated. The third color is obtained in the same manner.

The following examples are provided to illustrate the invention.

EXAMPLE 1

A yellow dye-donor element was prepared by coating the following layers in the order recited on a 6 μm poly(ethylene terephthalate) support:

(1) Dye-barrier layer of gelatin nitrate (0.19 g/m$^2$) coated from acetone and water, and (2) Dye layer containing the tetrahydroquinoline yellow dye illustrated above (0.27 g/m$^2$) and either 0, 0.054, 0.11 or 0.16 g/m$^2$ of stabilizer 10 in a cellulose acetate hydrogen phthalate binder (0.32 g/m$^2$) coated from a 2-butanone/tetrahydrofuran solvent mixture. On the back side of the element was coated a slipping layer of the type disclosed in U.S. Pat. No. 4,717,711 of Vanier et al.

A dye-receiving element was prepared by coating a solution of Makrolon 5705® (Bayer AG Corporation) polycarbonate resin (2.9 g/m$^2$ in a methylene chloride and trichloroethylene solvent mixture on an ICI Melinex 990® white polyester support.

The dye side of the dye-donor element strip 0.75 inches (19 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a Fujitsu Thermal Head (FTP-040MCS001) and was pressed with a spring at a force of 3.5 pounds (1.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were heated to generate a maximum density area. The voltage supplied to the print head was approximately 21v representing approximately 1.5 watts/dot (12 mjoules/dot).

The dye-receiving element was separated from the dye-donor element and the status A blue reflection density of the image was read. The image was then subjected to High-Intensity Daylight fading (HID-fading) for 4 days, 50. kLux, 5400° K., 32° C., approximately 25% RH and the density loss was calculated. The following results were obtained:

TABLE 1

| Dye-Donor Element with Stabilizer 10 (g/m$^2$) | Status A Blue Density | |
|---|---|---|
| | Before Fade | % Loss After Fade |
| 0 (Control) | 1.6 | 14 |
| 0.054 | 1.6 | 8.9 |
| 0.11 | 1.7 | 7.6 |
| 0.16 | 1.9 | 6.2 |

The above results indicate that stabilizer compound 10 was effective in reducing the amount of dye fade.

EXAMPLE 2

A stabilizer-donor element was prepared similar to the yellow dye-donor element of Example 1 except that no yellow dye was coated in the layer on top of the dye-barrier layer and stabilizer 10 was present at a concentration of 0.27 g/m$^2$.

A transfer was made as in Example 1 to the receiver using the control dye-donor element of Example 1 without any stabilizer. A second imagewise transfer was then made using the stabilizer sheet above in register with the same receiver. Thus the first transfer was to imagewise transfer dye and the second transfer was to imagewise transfer stabilizer. The same procedure was used as in Example 1 to obtain the following results:

TABLE 2

| Stabilizer-Donor Element (g/m²) | Status A Blue Density Before Fade | % Loss After Fade |
|---|---|---|
| 0 (Control) | 1.6 | 14 |
| 0.27 | 1.4 | 2 |

The above results indicate that stabilizer compound 10 was effective in reducing the amount of dye fade when applied from a separate stabilizer-donor element.

EXAMPLE 3

A yellow dye-donor element was prepared by coating the following layers in the order recited on a 6 μm poly(ethylene terephthalate) support:

(1) Dye-barrier layer of poly(acrylic acid) (0.18 g/m²) coated from a methanol and water mixture, and (2) Dye layer containing the following yellow dye (0.24 g/m²), FC-431 ® surfactant (3M Corp.) (0.03 g/m²), stabilizers 1, 8, 9, 10 or 16 identified in Table 3 (0.81 mmoles/m²) and a control without stabilizer in cellulose acetate butyrate (19% butyryl) (28% acetyl) (0.48 g/m²) coated for a tetrahydrofuran, acetone and cyclohexanone solvent mixtures.

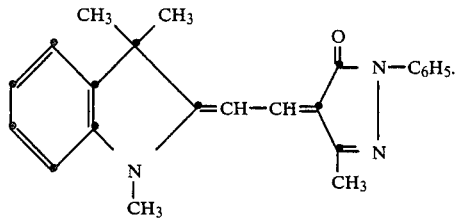

Stabilizers 6 and 7 and a control coating without stabilizer were coated from cellulose acetate butyrate (13% acetyl, 37% butyryl) (0.48 g/m²).

A slipping layer was coated on the back side of the element similar to that disclosed in U.S Pat. No. 4,717,711 of Vanier et al.

A dye-receiving element was prepared as in Example 1.

The dye side of the dye-donor element strip 1 inch (2.5 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a TDK Thermal Head (No. L-133) and was pressed with a spring at a force of 8.0 pounds (3.6 kg) against the dye-donor element side of the assemblage pushing it against the rubber roller.

The imaging electronics were activated causing the pulling device to draw the assemblage between the printing head and roller at 0.123 inches/sec) (3.1 mm/sec). Coincidentally, the resistive elements in the thermal print head were pulse-heated at increments from 0 up to 8 msec to generate a graduated-density image. The voltage supplied to the print head was approximately 22v representing approximately 1.5 watts/-dot (12 mjoules/dot) for maximum power.

The dye-receiving element was separated from the dye-donor element and the status A blue reflection density of each stepped image was read. The image was then subjected to High-Intensity Daylight fading (HID-fading) for 2 days, 50 kLux, 5400° K., 32° C., approximately 25% RH and the density was reread. The percent density losses at selected steps was calculated. The following results were obtained:

TABLE 3

| Stabilizer Compound | Status A Blue Density Step 6 Before Fade | Step 6 % Loss After Fade | Step 4 Before Fade | Step 4 % Loss After Fade |
|---|---|---|---|---|
| None - cont. | 1.2 | 50 | 0.6 | 67 |
| 1 | 1.9 | 38 | 0.9 | 57 |
| 8 | 1.8 | 16 | 0.9 | 29 |
| 9 | 1.5 | 22 | 0.8 | 43 |
| 10 | 1.7 | 4 | 1.1 | 7 |
| 16 | 1.3 | 34 | 0.7 | 48 |
| None - cont. | 1.2 | 48 | 0.4 | 72 |
| 6 | 1.8 | 6 | 1.1 | 14 |
| 7 | 1.7 | 6 | 1.1 | 13 |

The above results indicate that various stabilizer compounds were effective in reducing the amount of dye fade.

EXAMPLE 4

Dye-donor elements were prepared as in Example 3 except that the following black azo dye was used at 0.0029 g/m²:

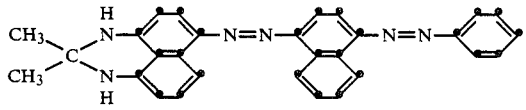

The same stabilizers were evaluated as in Example 3 using the same procedure and dye-receiver. The Status A red density values were obtained after fading for 4 days at 5.4 kLux. The following results were obtained:

TABLE 4

| Stabilizer Compound | Status A Red Density Step 7 Before Fade | Step 7 % Loss After Fade | Step 5 Before Fade | Step 5 % Loss After Fade |
|---|---|---|---|---|
| None - cont. | 1.3 | 32 | 0.7 | 45 |
| 1 | 1.8 | 18 | 1.3 | 26 |
| 8 | 1.8 | 13 | 1.4 | 21 |
| 9 | 1.5 | 25 | 0.8 | 40 |
| 10 | 1.1 | 15 | 0.7 | 22 |
| 16 | 1.4 | 17 | 1.0 | 20 |
| None - cont. | 1.8 | 28 | 1.0 | 44 |
| 6 | 2.1 | 8 | 1.7 | 15 |
| 7 | 1.9 | 13 | 1.7 | 16 |

The above results indicate that various stabilizer compounds were effective in reducing the amount of dye fade for another dye.

The invention has been described in detail with particular reference to preferred embodiments thereof, but it will be understood that variations and modifications can be effected within the spirit and scope of the invention.

What is claimed is:

1. A stabilizer-donor element for thermal dye transfer comprising a support having on one side thereof a stabilizer dispersed in a polymeric binder, and on the other side thereof a slipping layer comprising a lubricant, said stabilizer comprising a multialkoxy-substituted aromatic compound or a singlet oxygen quencher metal chelate.

2. The element of claim 1 wherein said polymeric binder also has dispersed therein a dye.

3. The element of claim 2 wherein said support comprises poly(ethylene terephthalate) and the dye layer comprises sequential repeating areas of cyan, magenta and yellow dye.

4. The element of claim 1 wherein said stabilizer is a multialkoxy-substituted aromatic compound.

5. The element of claim 1 wherein said stabilizer is a singlet oxygen quencher metal chelate.

6. The element of claim 5 wherein said metal is nickel(II).

7. The element of claim 1 wherein said stabilizer has the formula:

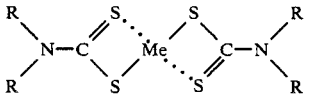

wherein Me is metal and each R independently represents a substituted or unsubstituted alkyl group having from 1 to about 10 carbon atoms, a substituted or unsubstituted aryl group having from about 6 to about 10 carbon atoms, or two R's may be combined together with the N to which they are attached to form a ring.

8. The element of claim 7 wherein Me is nickel(II) and each R is a n-butyl group.

9. In a process of forming a dye transfer image comprising imagewise-heating a dye-donor element comprising a support having thereon a dye layer comprising a dye dispersed in a polymeric binder and transferring a dye image to a dye-receiving element to form said dye transfer image, the improvement wherein said dye-donor element also contains a stabilizer comprising a multialkoxy-substituted aromatic compound or a singlet oxygen quencher metal chelate.

10. The process of claim 9 wherein said stabilizer is a singlet oxygen quencher metal chelate.

11. The process of claim 10 wherein said metal is nickel(II).

12. The process of claim 9 wherein said stabilizer has the formula:

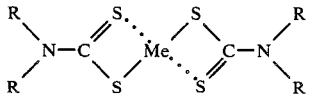

wherein Me is metal and each R independently represents a substituted or unsubstituted alkyl group having from 1 to about 10 carbon atoms, a substituted or unsubstituted aryl group having from about 6 to about 10 carbon atoms, or two R's may be combined together with the N to which they are attached to form a ring.

13. The process of claim 12 wherein Me is nickel(II) and each R is a n-butyl group.

14. The process of claim 9 wherein said support is poly(ethylene terephthalate) which is coated with sequential repeating areas of cyan, magenta and yellow dye containing said stabilizer and said process steps are sequentially performed for each color to obtain a three-color dye transfer image.

15. In a thermal dye transfer assemblage comprising:

(a) a dye-donor element comprising a support having thereon a dye layer comprising a dye dispersed in a polymeric binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said dye-donor element also contains a stabilizer comprising a multialkoxy-substituted aromatic compound or a singlet oxygen quencher metal chelate.

16. The assemblage of claim 15 wherein said stabilizer is a singlet oxygen quencher metal chelate.

17. The assemblage of claim 15 wherein said stabilizer has the formula:

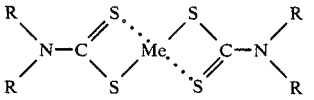

wherein Me is metal and each R independently represents a substituted or unsubstituted alkyl group having from 1 to about 10 carbon atoms, a substituted or unsubstituted aryl group having from about 6 to about 10 carbon atoms, or two R's may be combined together with the N to which they are attached to form a ring.

18. The assemblage of claim 17 wherein Me is nickel(II) and each R is a n-butyl group.

* * * * *